US007938469B2

(12) United States Patent
Ait-Mani

(10) Patent No.: US 7,938,469 B2
(45) Date of Patent: May 10, 2011

(54) TWEEZERS WITH GRIPPING ELEMENTS MOUNTED SWIVELLING ON BRANCHES

(75) Inventor: Abdenacer Ait-Mani, Saint-Egreve (FR)

(73) Assignee: Commissariat a l'Energie Atomique, Paris (FR)

( * ) Notice: Subject to any disclaimer, the term of this patent is extended or adjusted under 35 U.S.C. 154(b) by 1 day.

(21) Appl. No.: 12/588,148

(22) Filed: Oct. 6, 2009

(65) Prior Publication Data

US 2010/0096871 A1 Apr. 22, 2010

(30) Foreign Application Priority Data

Oct. 16, 2008 (FR) ..... 08 05735

(51) Int. Cl.
*B25B 9/02* (2006.01)

(52) U.S. Cl. ..... 294/99.2

(58) Field of Classification Search ..... 294/99.2, 294/1.1, 26; 606/210; 81/43
See application file for complete search history.

(56) References Cited

U.S. PATENT DOCUMENTS

| | | | | | |
|---|---|---|---|---|---|
| 1,758,490 | A | * | 5/1930 | Aderer | 294/99.2 |
| 3,399,583 | A | | 9/1968 | Hall | |
| 3,818,784 | A | * | 6/1974 | McClure | 294/99.2 |
| 3,980,861 | A | * | 9/1976 | Fukunaga | 219/230 |
| 4,389,912 | A | * | 6/1983 | Dallons et al. | 81/320 |
| 5,147,369 | A | * | 9/1992 | Wagner | 606/107 |
| 2002/0127514 | A1 | * | 9/2002 | Dietrich | 433/159 |

FOREIGN PATENT DOCUMENTS

| | | |
|---|---|---|
| GB | 769917 | 3/1957 |
| JP | A-2005-342840 | 12/2005 |
| WO | WO 91/19291 A1 | 12/1991 |
| WO | WO 2008/114912 A1 | 9/2008 |

* cited by examiner

*Primary Examiner* — Paul T Chin
(74) *Attorney, Agent, or Firm* — Oliff & Berridge, PLC

(57) ABSTRACT

The tweezers comprises two branches joined at a first end, a second end of each branch comprising a gripping element. The gripping element of each branch is mounted rotating freely around a swivel axis at the second end of said branch. The gripping element of each branch comprises a longitudinal axis perpendicular to the corresponding swivel axis, and a pad is fixed to a free end of said gripping element perpendicularly to said longitudinal axis of the gripping element.

7 Claims, 2 Drawing Sheets

TWEEZERS WITH GRIPPING ELEMENTS MOUNTED SWIVELLING ON BRANCHES

BACKGROUND OF THE INVENTION

The invention relates to a pair of tweezers comprising two branches joined at a first end, a second end of each branch comprising a gripping element, said gripping element of each branch being mounted rotating freely around a swivel axis at the second end of said branch.

STATE OF THE ART

Tweezers are designed for handling fragile objects. They have an application in microelectronics where they are used as gripping and handling tool for microelectronic components such as chips. In this type of use, it is necessary to avoid any risk of damaging the edges and the active top surface of the chip on which low-profile circuitry, for example as on CMOS chips or infrared detectors, or raised-profile circuitry, such as for example die-matrix chips, can be located.

As illustrated in FIG. 1, the tweezers commonly used comprise two branches 1*a* and 1*b* joined to one another at a first end 2. A second end 3 of each branch 1*a* and 1*b* comprises a gripping element 4 to pick up a microelectronic component. Gripping element 4 is located in the extension of the branches. Handling of microelectronic components with such tweezers requires a great deal of vigilance and dexterity from the operators. Indeed, depending on the environment where the tweezers are used, the operator can only have a small amount of latitude of movement. some positions are more comfortable for left-handed operators and others for right-handed operators.

To make handling of microelectronic components easier, tweezers exist manufactured by the Ideal-Tek Company one model of which comprises gripping elements 4, as in FIG. 1, in the form of tips which are removable and interchangeable. The tips have different shapes to be able to be adapted according to the use involved. This does however require disassembly of the tweezers each time to select the right tip. Moreover, if the environment changes in the course of handling, it is impossible to do the same with the tweezers.

OBJECT OF THE INVENTION

The object of the invention is to provide a pair of tweezers that are easy to handle and that do not present the drawbacks of the prior art.

This object is achieved by the fact that the gripping element of each branch comprises a longitudinal axis perpendicular to the corresponding swivel axis, and that a pad is fixed to a free end of said gripping element perpendicularly to said longitudinal axis of the gripping element.

According to one embodiment, the pad comprises a rod parallel to the longitudinal axis of the gripping element, sunk into a corresponding cavity of the gripping element, said gripping element being provided with a hole opening out into said cavity, said hole being threaded and having an axis perpendicular to said rod enabling the pad to be fixed by means of a screw screwed into said hole, exerting a pressure on the rod.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PREFERRED EMBODIMENTS

Figure 1:
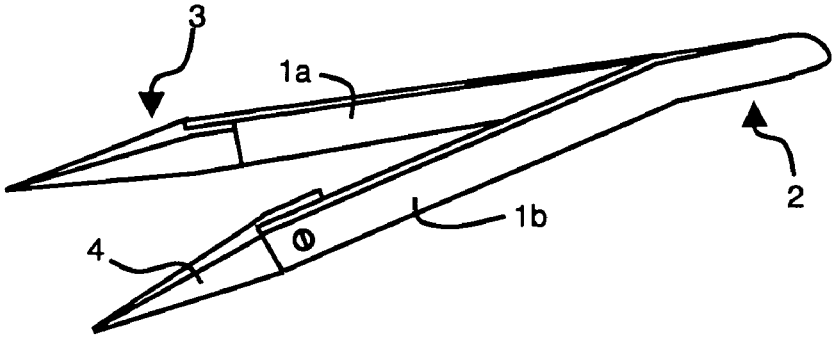
Figure 1 (Prior Art)
FIG. 1 represents a pair of tweezers with removable tips according to the prior art.
Figure 2:
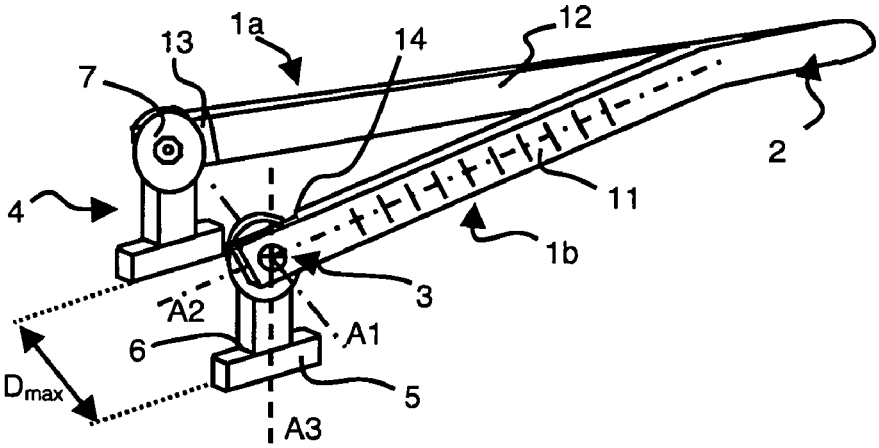
FIG. 2 illustrates a pair of tweezers with swivelling gripping means at the end of each branch according to the invention.

As illustrated in FIG. 2, the tweezers comprise two branches 1*a* and 1*b* joined to one another at a first end 2. A second end 3 of each branch 1*a* and 1*b* comprises a gripping element 4 mounted rotating freely around a swivel axis A1 on the second end of the corresponding branch 1*a* or 1*b*. Swivel axis A1 is preferably perpendicular to a longitudinal axis A2 of the branch.

Branches 1*a* and 1*b* have a set elasticity enabling the gripping means to be separated by a maximum distance Dmax when no stress is applied on branches 1*a* and 1*b*. Therefore, as gripping elements 4 are facing one another, by exerting a sufficient pressure on the branches, an operator can move the latter towards one another to pick up a chip. After he has picked the chip up and moved it, the operator can release the pressure and the tweezers revert to their original shape while at the same time releasing the chip.

As illustrated in FIG. 2, the gripping element of each branch preferably comprises a longitudinal axis A3 perpendicular to the corresponding swivel axis A1, and a pad 5 is preferably fixed to a free end 6 of gripping element 4 perpendicularly to longitudinal axis A3 of gripping element 4.

Gripping elements 4 and/or pads 5 are preferably removable thereby making it possible to adapt to the type of component to be moved, for example defined by its size. Each gripping element 4 can be joined respectively to second end 3 of a corresponding branch 1*a* by any means enabling free rotation thereof around swivel axis A1, itself perpendicular to longitudinal axis A2 of branch 1*a*. For example purposes, each branch 1*a*, 1*b* and the corresponding gripping element 4 comprise a through-hole located at the second end for the branch and at a joining end 7 for gripping element 4. A branch and a gripping element are joined by means of a bolt inserted in their respective holes and a counternut screwed onto the threading of the bolt to perform securing.

Figure 3:
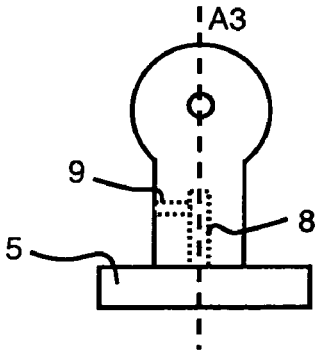
FIG. 3 illustrates a gripping element equipped with a pad.

As illustrated in FIGS. 2 and 3, pads 5 can be in the form of parallelepipedic bars and are made from materials, preferably plastic, that are not damaging for the component to be handled. For example pads 5 can be made from ABS (Acrylonitrile Butadiene Styrene), polystyrene, polypropylene preferably charged with carbon to avoid generating electrostatic charges able to damage the component to be moved, or from a material known under the name of Delrin®. Each pad 5 is preferably mobile in rotation along longitudinal axis A3 of corresponding gripping element 4. Pad 5 can thus be securedly attached to a rod 8 perpendicular to said pad 5, and gripping element 4 can comprise a cavity of corresponding shape to rod 8, the axis of which is parallel to longitudinal axis A3 of gripping element 4. Once inserted in cavity, rod 8 can then be secured by a screw screwed into a threaded hole 9 opening out into the cavity, preferably perpendicularly to the latter. The pressure exerted by the screw on the rod 8 in the cavity is then sufficient to perform securing. Mounting of the pad then enables its angle to be adjusted with respect to the plane containing branch 1*a* and gripping element 4 of the tweezers.

Joining end 7 of each gripping element preferably has a rounded shape. This rounded shape prevents the tweezers from getting stuck, in particular when handling in a case. It also allows total free rotation of the branches.

Figure 5:
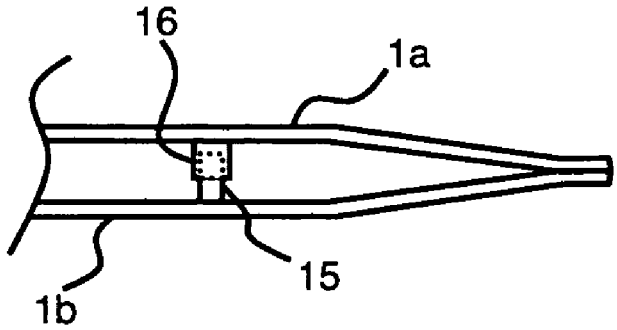
FIG. 5 schematically illustrates another alternative embodiment of tweezers equipped with locking means.

According to a development, the tweezers comprise locking means for locking the distance separating gripping elements 4. Thus, when an operator picks a component up, he can lock clamping of the tweezers and move the component without any risk of dropping it by inadvertently release the pressure exerted by his fingers on branches 1*a* and 1*b*. The locking means can be in the form of an operating device using the principle of a retractable system of the ballpoint pen type. Conventionally, this involves two coaxial bodies. One body corresponds to a cap free in translation in a main body comprising a bore designed to receive the cap and a locking mechanism of the cap to block translation thereof (not shown). A pressure exerted on the cap makes the latter slide in the main body until the travel of the cap reaches a predefined threshold and triggers the mechanism locking said cap in the retracted position in the main body. In the retracted position, the pressure can be released, and the cap 15 then remains in this position. A new pressure on the mechanism unlocks the cap which then becomes free in translation again in the main body. This type of operating device is commonly used in the field of ballpoint pens. As illustrated in FIG. 5, the end of main body 16 opposite to the cap 15 is securedly attached to one of branches (1*a* in FIG. 5) of the tweezers, and the free end of cap 15 is securedly attached to the opposite branch (1*b* in the figure). In this way, in the retracted position, the distance separating the two pads is fixed enabling a component of predetermined size, clamped between the pads, to be moved effortlessly.

Figure 4:
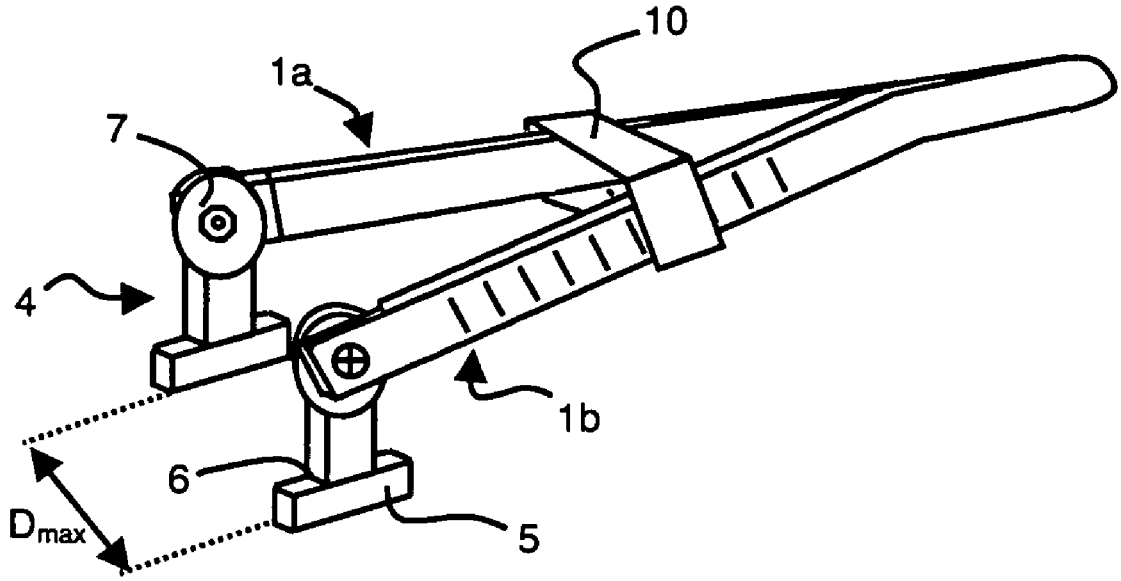
FIG. 4 illustrates an alternative embodiment of tweezers equipped with locking means.

According to another example illustrated in FIG. 4, the locking means are in the form of a simple sliding ring 10. The two branches 1*a* and 1*b* of the tweezers are inserted into ring 10, and when ring 10 slides in the direction of gripping elements 4, the latter begins to rub on external surfaces 11 of branches 1*a* and 1*b*. The closer ring 10 moves towards gripping elements 4, the more the frictions increase, thereby reducing the distance separating the two gripping elements 4 and if applicable the pads 5.

The use of gripping means 4 equipped with pads 5 that are free in rotation with respect to swivel axis A1 enables the pads to be always kept parallel to the plane of a horizontal lab table and therefore to the edges of the microelectronic component to be handled placed on the lab table. Furthermore, due to the swivel link between the branches and the gripping elements, a chip can be picked up from a box or in an environment where the vertical position of the arms is not possible. This advantageous configuration is due to gravity and to the sufficient weight of the gripping elements. The weight of gripping elements 4 must be sufficient to make the friction forces negligible at the level of the branch/gripping element link to enable free rotation of gripping elements 4 around axis A1. The minimum weight of a gripping element is preferably at least 8 grams.

The branches and gripping elements are preferably made from a material that is easy to machine such as aluminum.

According to a development, the end of each branch 1*a*, 1*b* designed to receive a gripping element 4 comprises a depression 13 on an inside face 12 of branch 1*a*, 1*b*. Gripping element 4 is then coupled to branch 1*a*, 1*b* on the side where depression 13 is located and its thickness is preferably equal to the thickness of depression 13. Thus, when the tweezers are handled, depending on the angle of the branches 1*a*, 1*b* with respect to the horizontal, gripping elements 4 come up against the stop formed by a wall 14 delineating the depth of depression 13.

The invention claimed is:

1. A pair of tweezers comprising:

two branches joined at a first end, a second end of each branch comprising a gripping element, said gripping element of each branch being mounted rotating freely around a swivel axis at the second end of said branch, wherein the gripping element of each branch comprises a longitudinal axis perpendicular to the corresponding swivel axis, and a pad is fixed to a free end of said gripping element perpendicularly to said longitudinal axis of the gripping element, and the pad comprises a rod parallel to the longitudinal axis of the gripping element, sunk into a corresponding cavity of the gripping element, said gripping element being provided with a hole opening out into said cavity, said hole being threaded and having an axis perpendicular to said rod enabling the pad to be fixed by means of a screw screwed into said hole, exerting a pressure on the rod.

2. The tweezers according to claim 1, wherein the gripping element or the pad is removable.

3. The tweezers according to claim 1, wherein the pads are made from materials chosen Delrin, ABS, Polystyrene, or Polypropylene charged with carbon.

4. The tweezers according to claim 1, comprising locking means for locking the distance separating the gripping elements.

5. The tweezers according to claim 4, wherein the locking means comprises a ring in which the branches of the tweezers are inserted.

6. The tweezers according to claim 4, wherein the locking means comprise a cap coaxial to a main body and free in translation in the main body, said main body comprising a locking mechanism to block the cap in the retracted position in the main body when the travel of the cap reaches a predefined threshold, the end of the main body opposite the cap being securedly attached to one of branches of the tweezers and the free end of the cap being securedly attached to the other branch.

7. The tweezers according to claim 1, wherein each pad is mobile in rotation along the longitudinal axis of the gripping element.

* * * * *